US006785997B2

(12) United States Patent
Oz

(10) Patent No.: US 6,785,997 B2
(45) Date of Patent: Sep. 7, 2004

(54) ACCESSORY MOUNT FOR A FIREARM

(75) Inventor: David Oz, London (GB)

(73) Assignee: T.D.I. Arms Systems Ltd, Tel Aviv (IL)

( * ) Notice: Subject to any disclaimer, the term of this patent is extended or adjusted under 35 U.S.C. 154(b) by 0 days.

(21) Appl. No.: 10/669,189

(22) Filed: Sep. 24, 2003

(65) Prior Publication Data

US 2004/0060222 A1 Apr. 1, 2004

(30) Foreign Application Priority Data

Sep. 26, 2002 (IL) ..... 151953

(51) Int. Cl.[7] ..... F41A 29/00

(52) U.S. Cl. ..... 42/94; 42/146; 42/90; 89/37.04; 89/37.03

(58) Field of Search ..... 42/94, 146, 132, 42/72, 90; 89/37.04, 37.03

(56) References Cited

U.S. PATENT DOCUMENTS 2,597,565 A * 5/1952 Chandler et al. ..... 362/110
4,351,224 A * 9/1982 Curtis ..... 89/37.04
5,590,484 A 1/1997 Mooney et al.
5,685,105 A 11/1997 Teetzel
5,852,892 A 12/1998 Bilgeri et al.
5,881,486 A 3/1999 Bilgeri et al.
6,289,622 B1 * 9/2001 Desch et al. ..... 42/94
6,318,015 B1 11/2001 Baumann et al.
6,378,237 B1 4/2002 Matthews et al.
6,622,416 B2 * 9/2003 Kim ..... 42/146
2004/0045209 A1 * 3/2004 Nielsen ..... 42/146

OTHER PUBLICATIONS

KAC RIS and RAS at www.quarterbore.com/kac/kac-risras.html(3 pages)Jun. 16, 2003.
KAC Free Float RAS at www.quarterbore.com/kac/kacf-fras.html(5 pages)Jun. 16, 2003.
SOPMOD M4 Carbine at www.quarterbore.com/kac/sop-mod.html (3 pages)Jun. 15, 2003.

* cited by examiner

*Primary Examiner*—J. Woodrow Eldred
(74) *Attorney, Agent, or Firm*—Robert L. Stone

(57) ABSTRACT

An accessory mount, and a method for mounting accessories for a hand held firearm having a barrel and a mounting rail coupled beneath the barrel, the accessory mount including a frame, defining a substantially flattened bottom surface and a track for mounting along the mounting rail, the frame having a cavity for receiving a light, and a bipod mount coupled adjacent the track and behind the light cavity and arranged to hold a bipod having legs which can be folded substantially adjacent the barrel.

21 Claims, 4 Drawing Sheets

ACCESSORY MOUNT FOR A FIREARM

FIELD OF THE INVENTION

The present invention relates to an accessory holder for mounting on a rifle, in general, and, in particular, to an accessory mount for mounting on an existing rail structure on the weapon.

BACKGROUND OF THE INVENTION

In recent years, the increasing complexity of combat has generated a need for weapons with increased accuracy and which are capable of supporting various accessories, such as flashlights, infrared and night vision scopes, laser spotters, and so forth. Consequently, a wide variety of mounts for rifles and other hand weapons have been developed which permit the mounting of lights scopes and the like on the weapon, often along the barrel.

A few examples are as follows. There is known from U.S. Pat. No. 5,590,484, to Mooney et al., a universal mount for a rifle which is formed to support a series of accessory devices simultaneously. The mount comprises an upper rail, a lower rail, a heat shield, and a retaining clip. When in place, this mount enables the rifle to be used as a weapons' platform, simultaneously supporting a plurality of accessory devices that enhance the operational capabilities of the weapon. A major feature of this invention is that the mount is secured to the barrel so that it "follows" the direction of the barrel when the latter undergoes thermal deformation as a result of firing successive rounds of ammunition, which enables the weapon to remain accurate despite the number of rounds fired or the temperature of the barrel.

A collimator holding device for a weapon barrel is described in U.S. Pat. No. 6,318,015 to Baumann, et al., which includes a casing extension on the casing of the weapon, and a longitudinal rail integrally formed on the top of the casing and on the casing extension as a mounting for the telescopic sight.

Another hand-held firearm with a light casing is described in U.S. Pat. No. 5,881,486 to Bilgeri et al. This firearm also includes a casing extension having a mounting for a telescopic sight.

There is shown in U.S. Pat. No. 6,378,237 to Matthews et al. a firearm with target illuminators including a track and slide combination including a slide on the target illuminator and a track structure clamped to the trigger guard on the weapon for that slide, and a releasable slide-in-track stop in the track and slide combination.

Another apparatus for attaching a flashlight to a firearm is illustrated in U.S. Pat. No. 5,685,105 to Teetzel. This apparatus includes a chassis containing a flashlight that can be mounted in various positions, depending on the weapon selected. The weapons factory installed hand grips are replaced by modified hand grips that contain the flashlight electronic controls, water proof activation switches, and power source.

These prior art devices suffer from a number of disadvantages. First, conventional flashlight mounts are substantially cylindrical in cross-section, such that their bottom surface is curved, so they provide no stability if the weapon is leaned upon a wall, for example. Second, generally a separate mount is required for each different accessory. However, if conventional accessory mounts are mounted beneath the barrel, it is difficult to comfortably grip the weapon, or places the user's hand in close proximity to the hot barrel during firing. Therefore, all the accessories are often mounted on top of the barrel.

It is also known to incorporate a bipod mount under the barrel of a rifle, such as an M16. These mounts generally include springs for folding the bipod legs when not in use, as seen, for example, in U.S. published application Ser. No. 2002/0089201. Conventional bipod mounts are generally mounted in such a way that they interfere with access to other accessories on the weapon and, when folded, provide an uncomfortable grip on the rifle. An alternative bipod, described in U.S. Pat. No. 5,852,892 to Bilgeri et al. is mounted beneath the barrel, in place of a lower mounting rail.

Accordingly, there is a long felt need for a light mount for a rifle or other hand held firearm which is provides a strong grip, and stability for the weapon, and it would be desirable if it included a bipod mount which does not interfere with the use of the firearm or any other accessory thereon.

SUMMARY OF THE INVENTION

The present invention provides an accessory mount for a hand held firearm having an elongate barrel and a mounting rail coupled beneath the barrel, especially a rifle, the accessory mount including a frame defining a substantially flattened bottom surface, and a track for mounting along the mounting rail, the frame having a cavity for receiving a light, and a bipod mount coupled adjacent the track and behind the light cavity and arranged to hold a bipod with legs folded substantially adjacent the barrel.

According to a preferred embodiment of the invention, the cavity for receiving a light defines a flashlight casing integrally formed in the mount.

According to a preferred embodiment of the invention, the accessory mount further includes at least one laser holding cavity. According to one embodiment, the mount includes two laser holding cavities, one for a visible laser and one for an infrared laser. Alternatively, the cavity for receiving a light may define a laser holder.

According to a preferred embodiment of the invention, the bottom surface includes a plurality of flattened rings, arranged for easy and secure gripping by fingers of a user. Preferably, the frame includes a cut-away portion whereby a handle is defined between the cut-away portion and the bottom surface. Most preferably, the handle includes a battery holder for the flashlight.

Further according to a preferred embodiment, the accessory mount includes built-in PPT switches on each side of the mount for activating the flashlight.

According to one embodiment, the mount further includes a four-way switch, for actuating a flashlight alone, a laser alone, a flashlight together with a laser, or off. Preferably, the mount includes a further switch for switching between a visible laser and an infrared (invisible) laser.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to an accessory holder or mount for a rifle or carbine, which provides a comfortable and secure grip under the barrel, and which permits the attachment and use of a plurality of lights and a bipod, without one accessory interfering with the actuation or operation of any of the others. In particular, the accessories can all be mounted beneath the barrel.

Figure 1A:
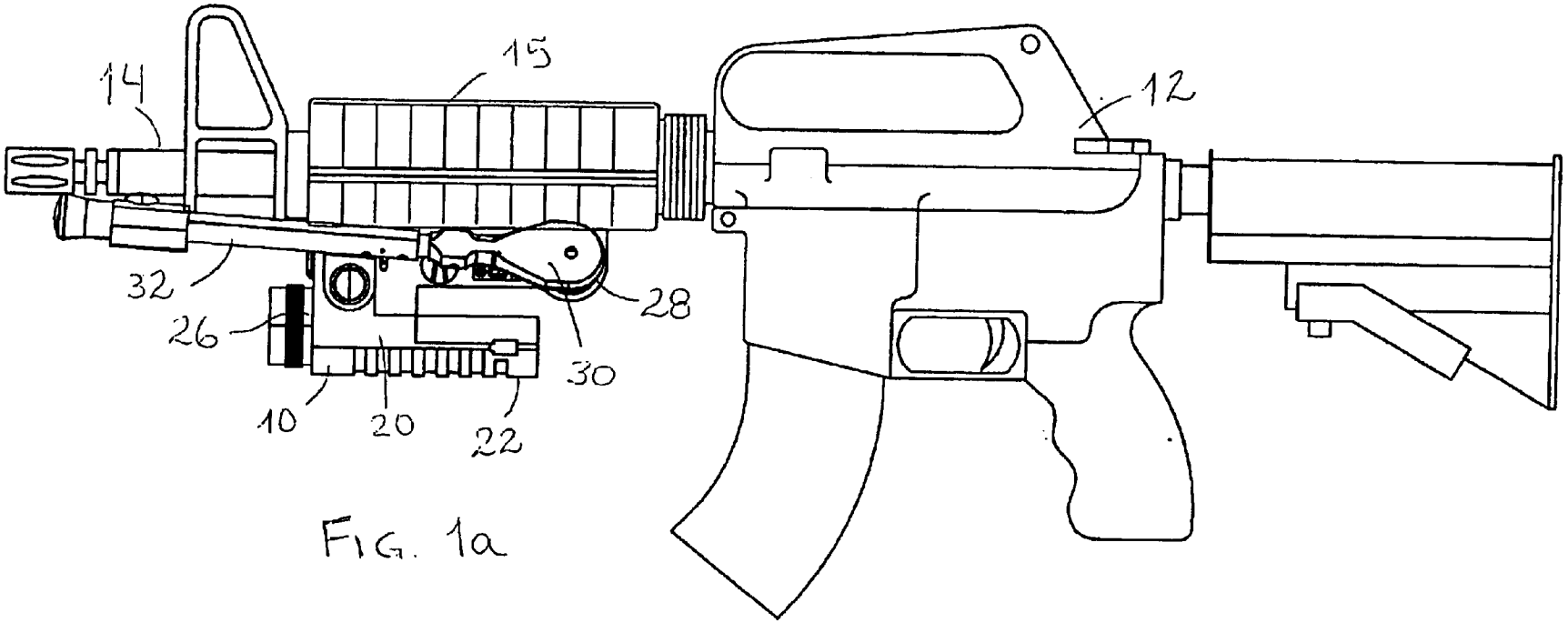
FIG. 1*a* is a plan view of an accessory mount according to one embodiment of the invention mounted on a rifle.

With reference to FIG. 1*a*, there is shown a plan view of an accessory mount 10 according to one embodiment of the invention mounted on a rifle 12 having a barrel 14 and a mounting rail (which can include a rail extension) (not shown) coupled to a hand guard 15 affixed around the barrel. Rifle 12 can be an M-16, or any other rifle or carbine, for which the mount of the present invention is particularly suitable. Alternatively, it will be appreciated that the mount of the present invention can be used on any hand held firearm having an elongate barrel and a mounting rail (of preferably about 10 cm or more) coupled to the barrel. For ease of discussion, in the present application, the term rifle will be used to include all these weapons.

Accessory mount 10 includes a frame 20 defining a substantially flattened bottom surface 22, and a track (not shown) for mounting along the mounting rail, preferably the rail beneath the barrel. The frame includes a cavity 26 for holding a light, typically a flashlight, and a bipod mount 28 coupled adjacent the track and behind the light cavity. Cavity 26 is an integrally formed flashlight casing, including contacts, for use with bulb and batteries. Bipod mount 28 is arranged to hold a bipod 30 with legs 32 folded substantially adjacent the barrel 14, as shown in FIG. 1*a*, when the bipod is not required or when carrying the rifle.

Figure 1B:
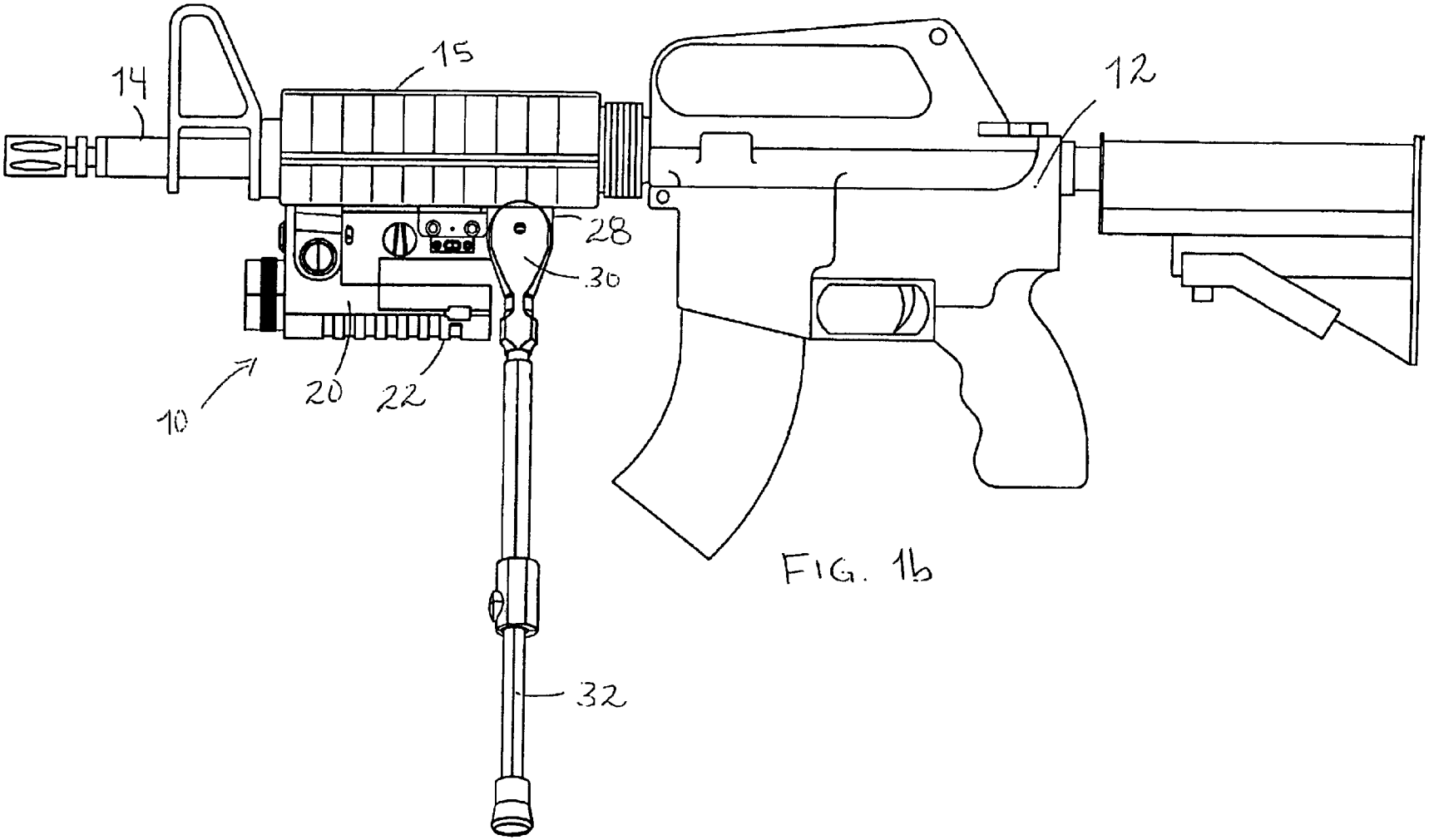
FIG. 1*b* is a plan view of the accessory mount of FIG. 1*a* with bipod legs unfolded for use.

FIG. 1*b* is a plan view of the accessory mount of FIG. 1*a* with the bipod legs 32 unfolded for use. It is a particular feature of the present invention that the bipod legs 32, when unfolded as in FIG. 1*b*, do not interfere with the user's access to or actuation of any switches or accessories on the accessory mount, as described in detail below.

Figure 4:
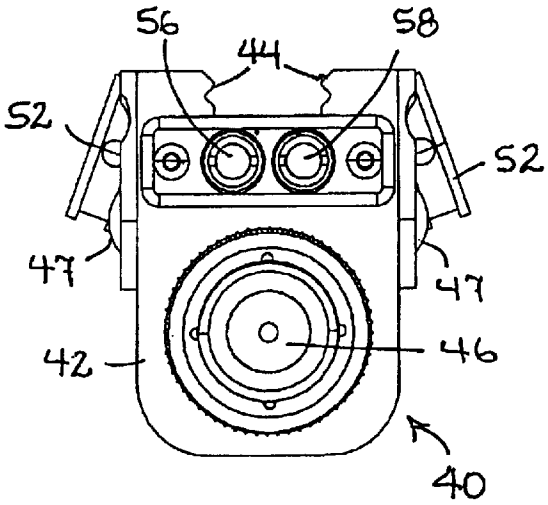
FIG. 4 is a front view of the accessory mount of FIG. 2.
Figure 2:
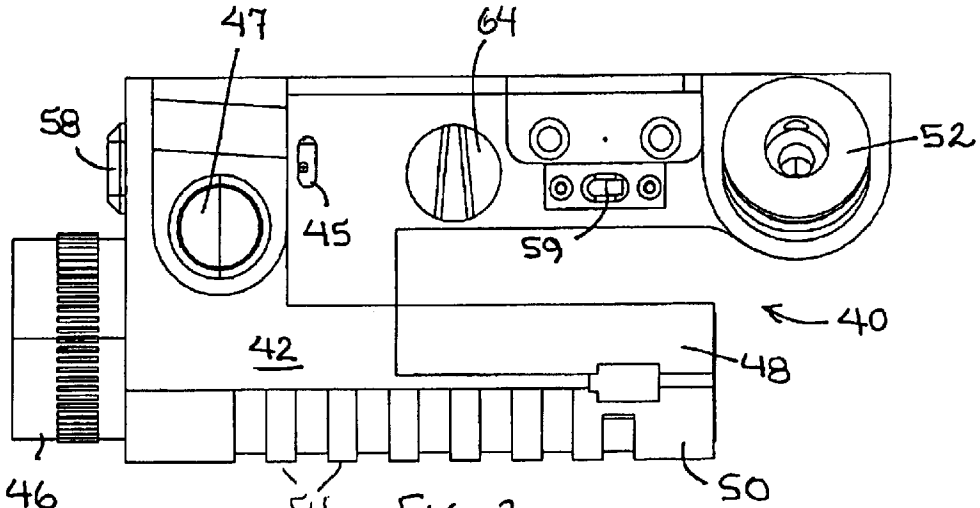
FIG. 2 is a schematic side view of an accessory mount according to one embodiment of the invention.
Figure 3:
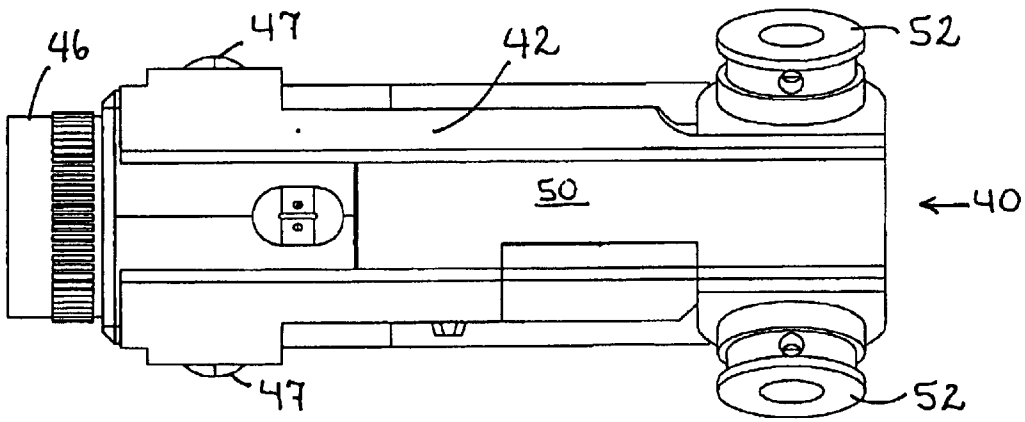
FIG. 3 is a bottom view of the accessory mount of FIG. 2.

Referring now to FIGS. 2, 3, and 4, there is shown an accessory mount 40 according to a preferred embodiment of the invention in respective a schematic side, bottom and front views. Accessory mount 40 includes a frame 42 having a track 44 for mounting along a mounting rail or rail extension of a hand-held firearm. A zeroing screw 45 is provided, as known, for zeroing the accessories with the barrel to increase precision of hitting the target. According to a preferred embodiment, as illustrated in FIG. 1, the mount is coupled beneath the barrel. Alternatively, if there is no integral bipod, the mount can be affixed on the side of the barrel, or in any other location where there is a mounting rail or rail extension. Such an option provides lights, but does not have the advantages of providing a hand grip for the user, as does the embodiment of FIG. 1.

It is a particular feature of the invention that the mounting location of the flashlight mount is adjustable along the mounting rail, rather than being defined in advance, as in conventional mounts. In this way, each user can adjust the location of the mount to his or her optimum location for gripping the mount, taking into account the length of the user's arm (and the length of the mounting rail). Preferably, locking means are provided for locking the mount in the desired location on the mounting rail.

Frame 42 includes a cavity 46 for receiving a light. As in the previous embodiment, cavity 46 can hold a conventional flashlight, visible laser or infrared laser, and preferably is, itself, an integral flashlight casing, with built-in contacts. A PTT switch 47 may be provided on each side of the mount for actuation of the light in cavity 46 by the thumb or forefinger of the user.

Preferably, frame 42 is partially cut-away, thereby defining a handle 48 with the bottom surface 50 of the frame. According to a preferred embodiment, handle 48 also serves as a hollow battery case for holding batteries, such as lithium batteries, to power the flashlight and other accessories. Preferably, surface 50 is a substantially flattened bottom surface, for leaning the rifle on a wall or other substantially flat surface.

It is a particular feature of the present invention that the bottom 50 of the frame provides a hand grip for a user, as well as a flat surface for resting the rifle. According to one embodiment of the invention, as illustrated in FIG. 2, the bottom surface defines a plurality of ribs 54, which improve a user's grip. In addition, the cut-away portion of the frame permits the user to wrap his or her fingers around the handle 48, increasing ease of gripping and stability of the rifle during aiming and firing.

Figure 5C:
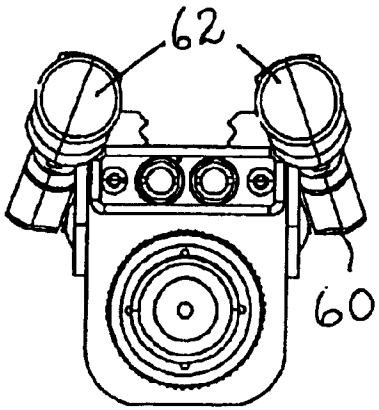
FIGS. 5*a*, 5*b*, and 5*c* are side, bottom and front views, respectively, of an accessory mount according to one embodiment of the invention with a bipod mounted thereon.
Figure 5A:
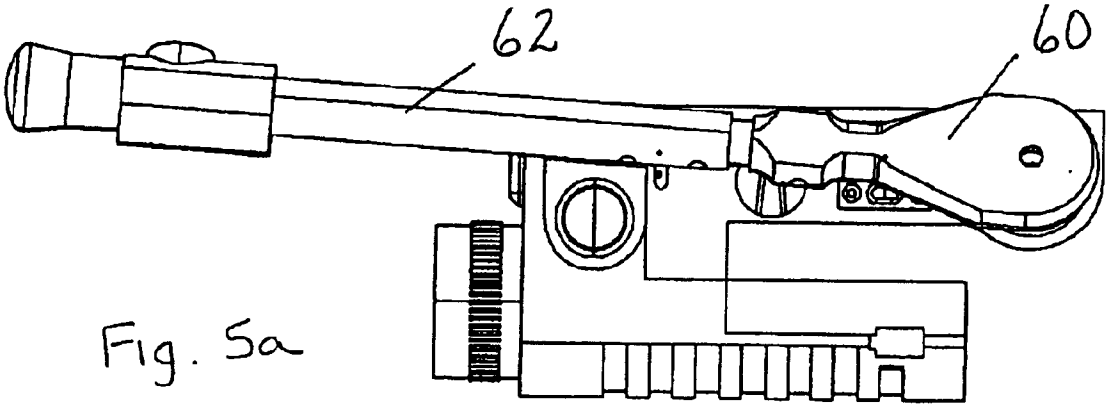
Figure 5B:
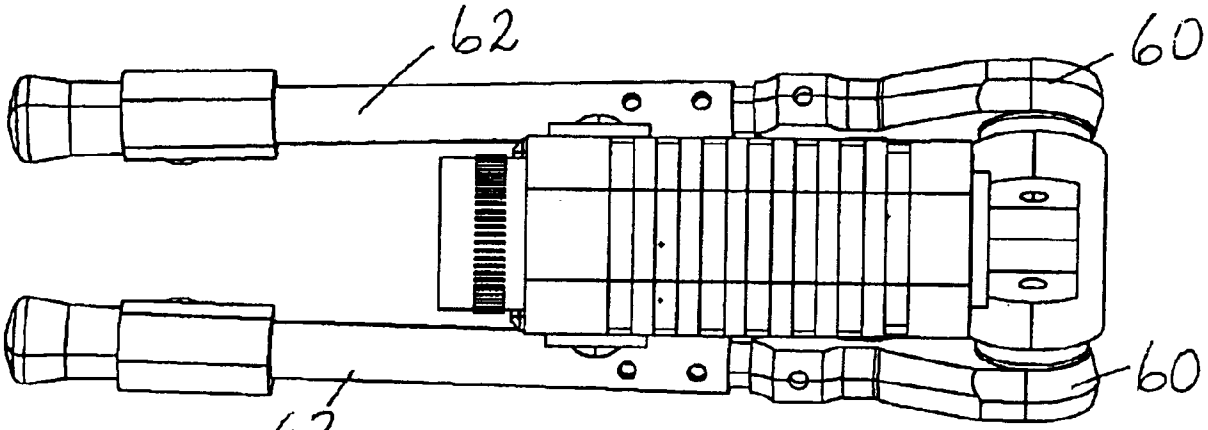

The mount of the present invention also includes an integral bipod mount 52. Bipod mount 52 is preferably coupled at the rear of the frame 40 adjacent the track 44 and behind the light cavities, and is arranged to hold a bipod with its legs folded between the frame and the barrel. In this way, a bipod can be mounted on the rifle without interfering with a user's access to any of the switches on the accessory mount, and without requiring the user to hold the legs of the bipod when they are folded. Rather, a hand grip is provided by the bottom of the frame and the handle, with the user's fingers beneath the bipod. This can be seen in FIGS. 5*a*, 5*b*, and 5*c*, which are side, bottom and front views, respectively, of an accessory mount according to one embodiment of the invention with a bipod 60 mounted thereon, with its legs 62 in a folded orientation. The legs are preferably provided with an auto-lock mechanism for locking the legs in the unfolded orientation (shown in FIG. 1*b*), and a quick release mechanism, such that a slight pull on the legs releases the auto-lock and permits the legs to fold up against the hand guard about the barrel.

Frame 40 further includes built-in cavities 56 and 58 for insertion of lasers, if desired. Cavities 56 and 58 include contacts for coupling the lasers to PTT switch 47 for turning the lasers on and off. Thus, the accessory mount can include a flashlight, a visible laser, and an IR laser, if desired. A switch 59 is preferably provided to permit the user to select the particular laser to be operated, e.g., visible or infrared. An additional four-way switch 64 is preferably provided to permit selection between operation of the flashlight, a laser, the flashlight and the laser, or off. It will be appreciated that PTT switch 47 will activate whichever light has been selected by four-way selector switch 64. According to one embodiment of the invention, PTT switch 47 has two modes—a first mode wherein a brief pressure on the switch provides momentary illumination of the light, and a second mode wherein firm pressure on the switch illuminates the light until a second press on the switch (on one side or the other of the handle) turns off the light. In addition, a suitable infrared filter can be mounted on the end of the flashlight to render the flashlight "invisible". In fact, the unit can be rendered substantially invisible, i.e., for use at night, by utilizing filters over all the flashlights, and operating the lasers in infrared mode.

An added advantage of the mount of the present invention is that it permits the compact mounting of various lights and bipod beneath the barrel, thereby leaving the rail above the barrel available for additional accessories, such as a telescopic sight, etc. Yet another option is to provide a flashlight cavity in the mount, and mount one or two lasers externally, on the barrel (rather than on the shroud or hand guard, where the flashlight and bipod are mounted). In this case, the wires from the lasers are extended into the mount on the barrel for actuation and switching from laser to laser.

It will be appreciated that the invention is not limited to what has been described hereinabove merely by way of example. Rather, the invention is limited solely by the claims which follow.

What is claimed is:

1. An accessory mount for a hand held firearm having a barrel and a mounting rail coupled beneath the barrel, the accessory mount comprising:

a frame, defining a substantially flattened bottom surface, and a track for mounting along the mounting rail, the frame having a cavity for receiving a light, and a bipod mount coupled adjacent the track and behind the light cavity and arranged to hold a bipod having legs which can be folded substantially adjacent the barrel.

2. The accessory mount according to claim 1, wherein said cavity defines a flashlight casing integrally formed in said mount.

3. The accessory mount according to claim 1, wherein said cavity defines a recess for receiving a laser.

4. The accessory mount according to claim 1, further comprising at least one recess for receiving a laser.

5. The accessory mount according to claim 4, including two laser-receiving recesses.

6. The accessory mount according to claim 4, wherein said at least one recess includes a recess for a visible laser or a recess for an infrared laser.

7. The accessory mount according to claim 1, wherein said bottom surface of the frame defines a plurality of ribs, arranged for easy and secure gripping by fingers of a user.

8. The accessory mount according to claim 1, wherein said frame includes a cut-away portion whereby a handle is defined between the cut-away portion and the bottom surface.

9. The accessory mount according to claim 8, wherein said handle includes a battery holder.

10. The accessory mount according to claim 2, further comprising built-in PPT switches on each side of the mount for activating the flashlight.

11. The accessory mount according to claim 4, further comprising a four-way switch, for actuating a flashlight, a laser, a flashlight and a laser, or off.

12. The accessory mount according to claim 5, further comprising a laser selector switch for switching between a visible and an infrared laser.

13. The accessory mount according to claim 1, wherein said track is arranged for adjustable mounting along the mounting rail.

14. The accessory mount according to claim 4, further including a flashlight mounted in an integral flashlight cavity, an infrared laser mounted in a first laser holder, and a visible laser mounted in a second laser holder.

15. The accessory mount according to claim 1, wherein said legs are provided with an auto-lock mechanism for locking the legs in the unfolded orientation, and a quick release mechanism, such that a slight pull on the legs releases the auto-lock.

16. A method for mounting accessories on a rifle having a barrel and a mounting rail coupled to the barrel, the method comprising:

preparing a frame, said frame defining a substantially flattened bottom surface and a track for mounting along the mounting rail;

creating a cavity in said frame for receiving a light; and creating an integral bipod mount on said frame adjacent said track and behind said cavity, said bipod mount being arranged to hold a bipod having legs which can be folded substantially adjacent the barrel.

17. The method according to claim 16, further comprising cutting away a portion of said frame so as to define a handle with said bottom surface, whereby fingers of a user holding the rifle can grip the bottom surface and curl around the handle.

18. The method according to claim 16, wherein said step of creating a cavity includes creating a cavity defining an integral flashlight casing.

19. The method according to claim 16, further comprising creating at least one laser holding recess in said mount.

20. The method according to claim 19, including creating a recess for holding a visible laser, and a recess for holding an infrared laser.

21. The method according to claim 19, wherein said steps of creating a cavity and creating a recess include providing built-in contacts in the cavity and recess coupled to a finger-operated switch in the mount.

* * * * *